US005338222A

United States Patent [19]

Boteler

[11] Patent Number: 5,338,222

[45] Date of Patent: Aug. 16, 1994

[54] CLAMPING ASSEMBLY FOR ELECTRICAL CABLES

[75] Inventor: William C. Boteler, Bridgeport, Conn.

[73] Assignee: Hubbell Incorporated, Orange, Conn.

[21] Appl. No.: 11,802

[22] Filed: Feb. 1, 1993

[51] Int. Cl.[5] ..... H01R 13/58

[52] U.S. Cl. ..... 439/469; 439/459

[58] Field of Search ..... 439/469, 459, 460, 461, 439/465, 466, 467, 472, 473

[56] References Cited

U.S. PATENT DOCUMENTS

| | | | |
|---|---|---|---|
| 2,577,748 | 12/1951 | Gillespie | 285/6.5 |
| 2,911,616 | 11/1959 | Townsend | 339/223 |
| 3,393,395 | 7/1968 | Hubbell | 339/91 |
| 3,402,382 | 9/1968 | De Tar | 339/103 |
| 3,437,980 | 4/1969 | Smith | 339/103 |
| 3,621,449 | 11/1971 | Bridle | 439/436 |
| 3,784,961 | 1/1974 | Gartland, Jr. | 339/107 |
| 3,856,371 | 12/1974 | Forsyth | 312/195 |
| 3,865,461 | 2/1975 | Ludwig | 339/103 R |
| 4,080,036 | 3/1978 | Hagel | 339/103 R |
| 4,178,056 | 12/1979 | Lee | 339/103 R |
| 4,213,667 | 7/1980 | Wittes | 339/103 R |
| 4,323,725 | 4/1982 | Müller | 439/459 |
| 4,632,489 | 12/1986 | Skinner | 439/459 |
| 4,648,680 | 3/1987 | Gamarra | 439/459 |
| 4,931,023 | 6/1990 | Browne | 439/457 |
| 5,021,006 | 6/1991 | Fargeaud et al. | 439/469 |
| 5,217,389 | 6/1993 | Mackay et al. | 439/466 |

FOREIGN PATENT DOCUMENTS

| | | | |
|---|---|---|---|
| 138392 | 10/1979 | Fed. Rep. of Germany | 439/460 |

*Primary Examiner*—Larry I. Schwartz
*Assistant Examiner*—Hien D. Vu
*Attorney, Agent, or Firm*—Jerry M. Presson; Alfred N. Goodman

[57] ABSTRACT

An electrical connector includes a main body having an axial passage therethrough for receiving an electrical cable and a fixed clamping jaw extending from an upper face of the main body. A movable jaw is interconnected with the clamping jaw by a plurality of screws for applying clamping forces between the fixed jaw and the movable jaw. A pivoting clamping jaw is provided which is movable from a first position extending into the axial passage in which the connector can clamp a standard size cable to a second position in which the connector can clamp an electrical cable having a smaller diameter than standard. The pivoting clamping jaw comprises a shaft and a pair of jaws extending tangentially therefrom and perpendicular to one another, one of the jaws being longer than the other.

40 Claims, 4 Drawing Sheets

CLAMPING ASSEMBLY FOR ELECTRICAL CABLES

FIELD OF THE INVENTION

The present invention is directed to a clamping assembly for securing an electrical cable with an electrical device. More specifically, the invention relates to a clamping assembly in combination with an electrical connector which can alternately accept and clamp different-sized electrical cables.

BACKGROUND OF THE INVENTION

Electrical devices such as electrical connectors typically have an electrical cable extending from the device. It is necessary to securely fasten the electrical cable to the electrical device to prevent the conductors from being pulled from their terminations, which can damage the conductors and the electrical device. In addition, pulling or tearing the electrical conductors from their terminations in the electrical device can result in the device becoming inoperable and can result in serious injury to the user due to shorting of the electrical current being carried in the conductors. Electrical connectors and other electrical devices typically include an assembly for clamping or otherwise securing the end of the electrical cable to the device. Electrical devices and in particular electrical connectors are primarily constructed for use with a standard size cable or a limited range of cable sizes. However, there are instances where cables smaller than the standard size are required. Thus, it is advantageous to have an electrical connector or other device that is able to accommodate different-sized electrical cables. Many of the electrical devices currently available are not able to effectively accommodate different-sized electrical cables.

Examples of such assemblies for securing a standard size electrical cable in a connector or other electrical device are disclosed in U.S. Pat. Nos. 2,911,616 to Townsend and 3,402,382 to De Tar. These devices generally include a threaded screw extending through an outer wall of the housing of the device to press the electrical cable against the opposite side of the housing. This arrangement has the disadvantage of being limited in the extent of the translational movement of the screw and thus limited in size of the electrical cable which can be secured. These devices do not always effectively grip electrical conductors of different sizes.

Another common construction of electrical devices includes a fixed clamping jaw and a movable clamping jaw which are biased toward each other by screws or other means to grip the electrical cable. Examples of this type of electrical device are shown in U.S. Pat. Nos. 4,046,961 to Hoffman; 3,784,961 to Gartland Jr.; 3,605,059 to Lipinski; and 3,856,371 to Poliak et al. Of these prior art devices, only U.S. Pat. No. 3,784,961 to Gartland is specifically directed to a clamp assembly capable of accommodating cables of different diameters. The clamp assembly disclosed in that patent includes a recess in the fixed jaw and a recess in the movable jaw which together accommodate large size cables. An insert can be inserted into the recess of the fixed jaw to reduce the dimension of the passageway between the jaws so as to effectively grip the cable. Although this structure utilizing the insert effectively grips cables of different diameters, it is necessary to remove the movable jaw from the assembly to remove the insert. Once the insert is removed from the jaw, the insert is usually lost or discarded, which prevents the jaw from accommodating a small size cable. Since the insert fits loosely in the clamping jaw, it tends to become separated from the clamping jaw during shipping. Finally, failure to remove the insert when clamping a large size cable may result in damage to the cable or the connector.

The above-noted devices demonstrate a continuing need in the art for an electrical device that is able to accommodate different size electrical cables. There is further a need for electrical devices where the assembly for accommodating different size cables is captively retained with the main body of the device to prevent loss of components.

SUMMARY OF THE INVENTION

Accordingly, it is a primary object of this invention to produce a clamping assembly for an electrical connector that is able to accommodate electrical cables of different size.

Another object of this invention is to provide a clamping assembly for an electrical connector with a minimum number of moving components.

Another object of this invention is to provide a clamping assembly for an electrical connector where the various components do not require disassembly to accommodate different size cables.

A further object of the invention is to provide a clamping assembly for an electrical device including a jaw movable from a first position to accommodate a small size cable to a second position to accommodate a larger size cable.

The above objects are basically attained by a clamping assembly for clamping at least two different size electrical conductors, the assembly comprising a main body having an axial passage for receiving an electrical cable; first clamping means coupled to said main body about a pivotal axis perpendicular and chordal to said axial passage, said first clamping means including first and second jaws extending transversely therefrom with respect to said pivotal axis, said first clamping means being pivotable from a first position where said first jaw faces said axial passage to a second position where said second jaw faces said axial passage; second clamping means being movable with respect to said axial passage and facing said first clamping means; and means interconnecting said first clamping means and said second clamping means for applying a clamping force between said first and second clamping means.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

Referring now to the drawings which form a part of this original disclosure.

DETAILED DESCRIPTION OF THE INVENTION

Figure 1:
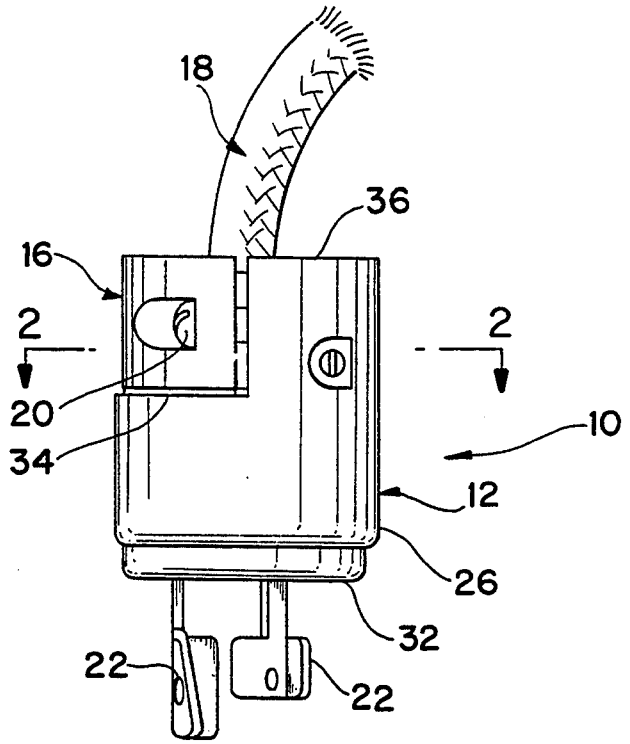
FIG. 1 is a side elevational view of an embodiment of the invention showing an electrical connector receiving a standard size electrical cable.

As seen in FIGS. 1–10, the clamping assembly in accordance with the invention is an electrical connector 10 comprising a main body 12 having a pivotal clamping jaw 14 and a movable clamping jaw 16 for clamping an electrical cable 18 within the connector 10. The movable clamping jaw 16 is coupled to the main body 12 by a pair of screws 20 for biasing the movable clamping jaw 16 toward the pivotal clamping jaw 14 and applying clamping forces to the electrical cable 18 between the clamping jaws 14 and 16.

In the embodiment of FIGS. 1–10, the electrical connector 10 is illustrated as a male electrical connector including three electrical contacts shown as blades or prongs 22. The male electrical connector 10 is connected to a female receptacle by inserting the blades into the receptacle and angularly translating the blades therein to lock the connector and receptacle together. In alternative embodiments, the electrical connector may be a female receptacle or a coupling for providing electrical connections between two electrical cables.

Figure 2:
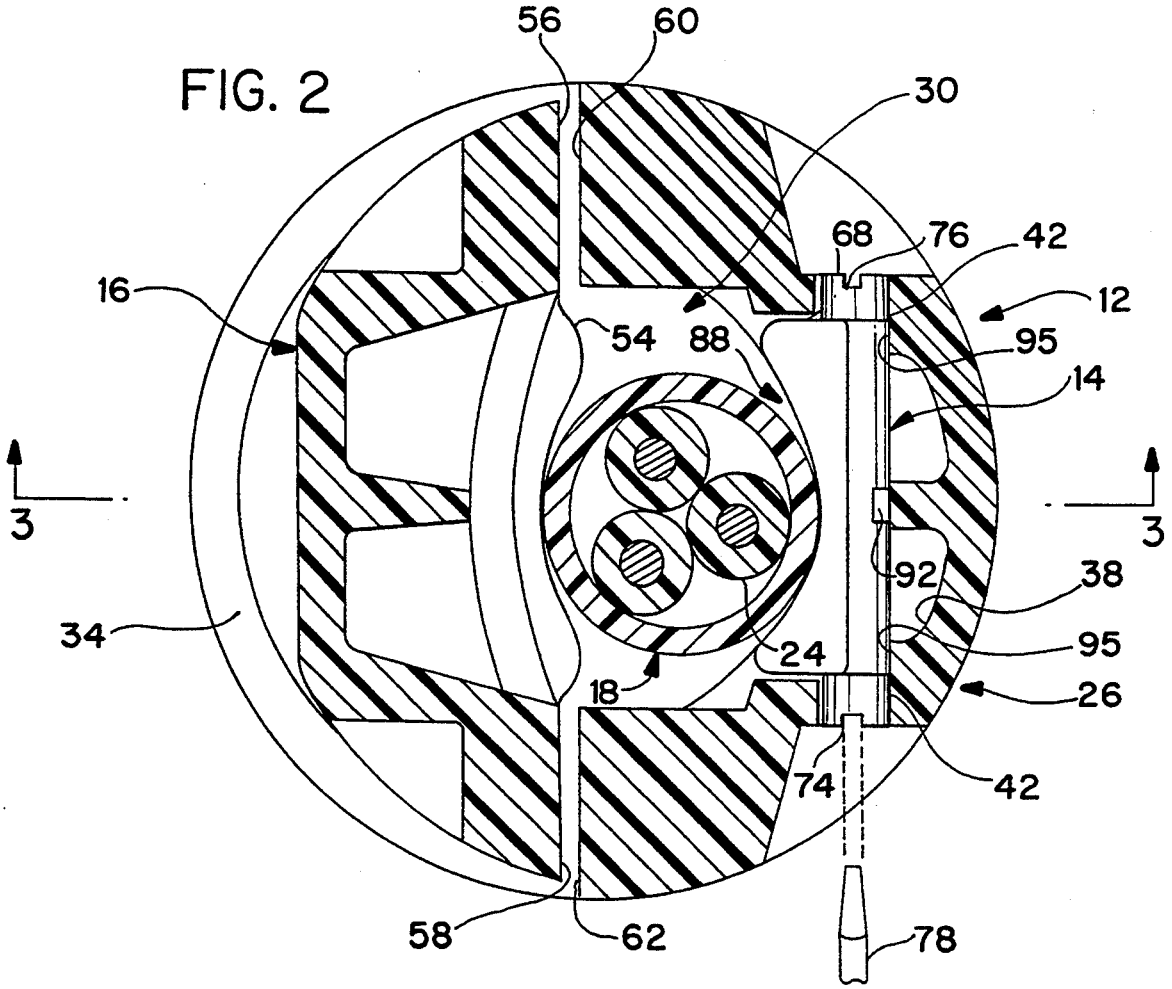
FIG. 2 is a cross-sectional top plan view of the embodiment of FIG. 1 as seen along line 2—2 of FIG. 1 showing the pivotal clamping jaw in a position to accommodate a standard size electrical cable.

The electrical cable 18 is a cable having at least one and preferably a plurality of smaller insulated electrical conductors therein. As shown in FIG. 2, the electrical cable 18 includes three insulated conductors 24 encased by a primary insulating sheath. The insulated conductors 24 have exposed ends (not shown) for electrical connection to the blades 22 of the connector 10 in a conventional manner.

Figure 3:
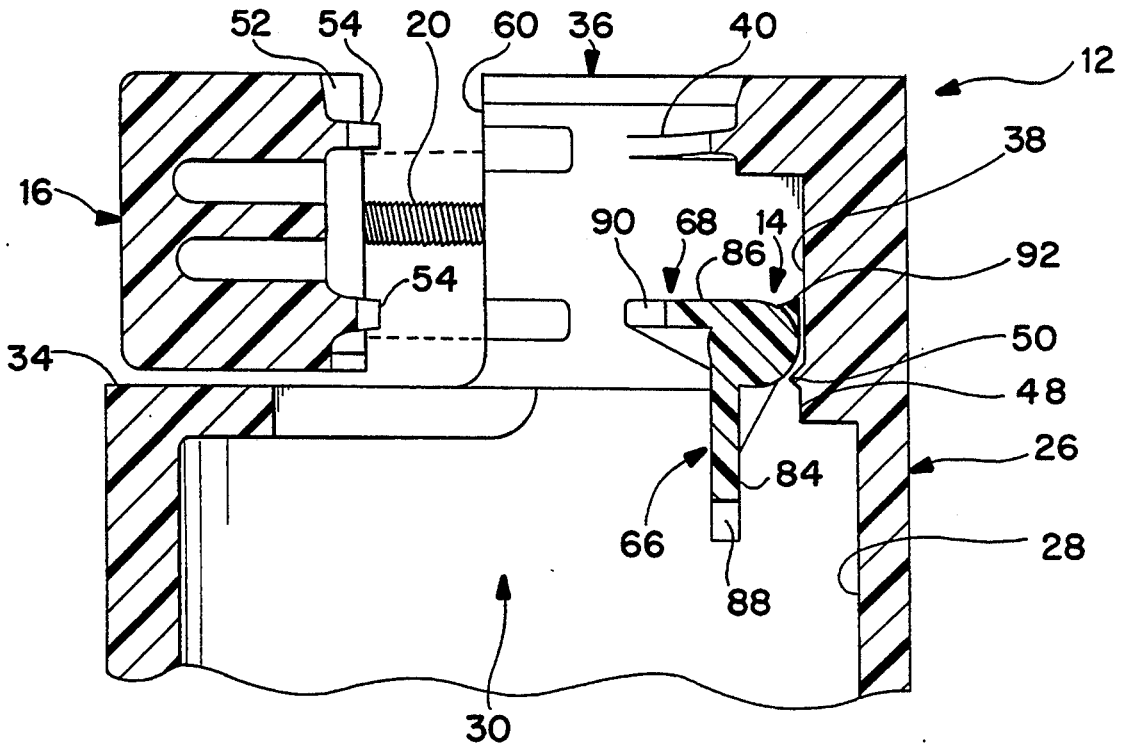
FIG. 3 is a partial cross-sectional view of the embodiment of FIG. 1 as seen along line 3—3 of FIG. 2 with the electrical cable removed and the pivotal clamping jaw being in a position to accommodate a standard size electrical cable.

The main body 12 of the electrical connector 10 comprises a cylindrical outer wall 26 and an inner wall 28 to define an axial passage 30 as seen in FIGS. 2 and 3. The electrical blades 22 extend axially from a lower end 32 of the main body 12. The electrical cable 18 enters the axial passage 30 from the top end 34 of the main body 12. The main body is preferably made from an insulating plastic material.

As shown in FIG. 1, the main body 12 includes a step portion extending axially from the main body and defining a fixed jaw 36. The fixed jaw 36 extends from the top end 34 of the body 12 and has a substantially semicircular cross-section as seen in FIG. 2. The inner wall 28 of the main body 12 continues through the fixed jaw 36. The fixed jaw 36 includes an inner wall 38 which is a continuation of the inner wall 28 of the main body 12. The inner wall 38 has a substantially contoured shape surrounding the axial passage 30. A raised gripping rib 40 extends radially inwardly from the surface of the inner wall 38 to assist in gripping the electrical cable 18 as discussed hereinafter in greater detail. In one embodiment, the gripping rib 40 is disposed in a spiral fashion with respect to the axial passage 30.

Figure 4:
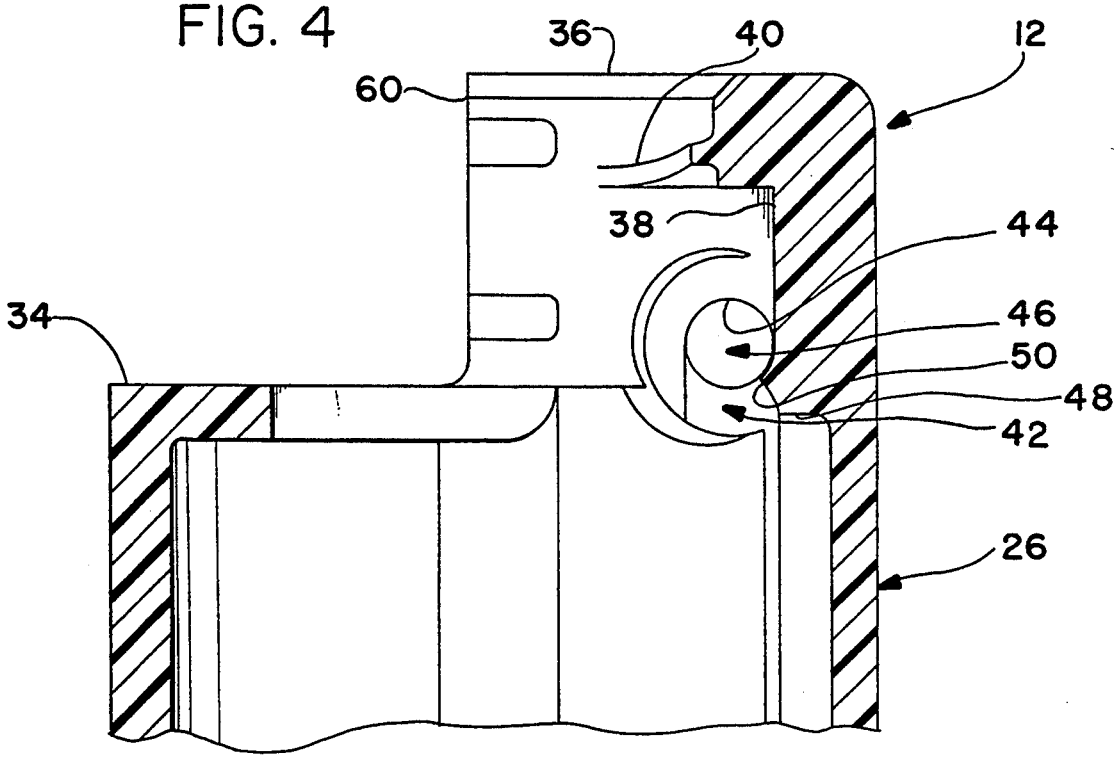
FIG. 4 is a cross-sectional view similar to FIG. 3 of the main body of the electrical connector with the pivotal clamping jaw removed and showing one of the recesses in the side wall of the main body for pivotally coupling the pivotal clamping jaw in the main body.
Figure 6:
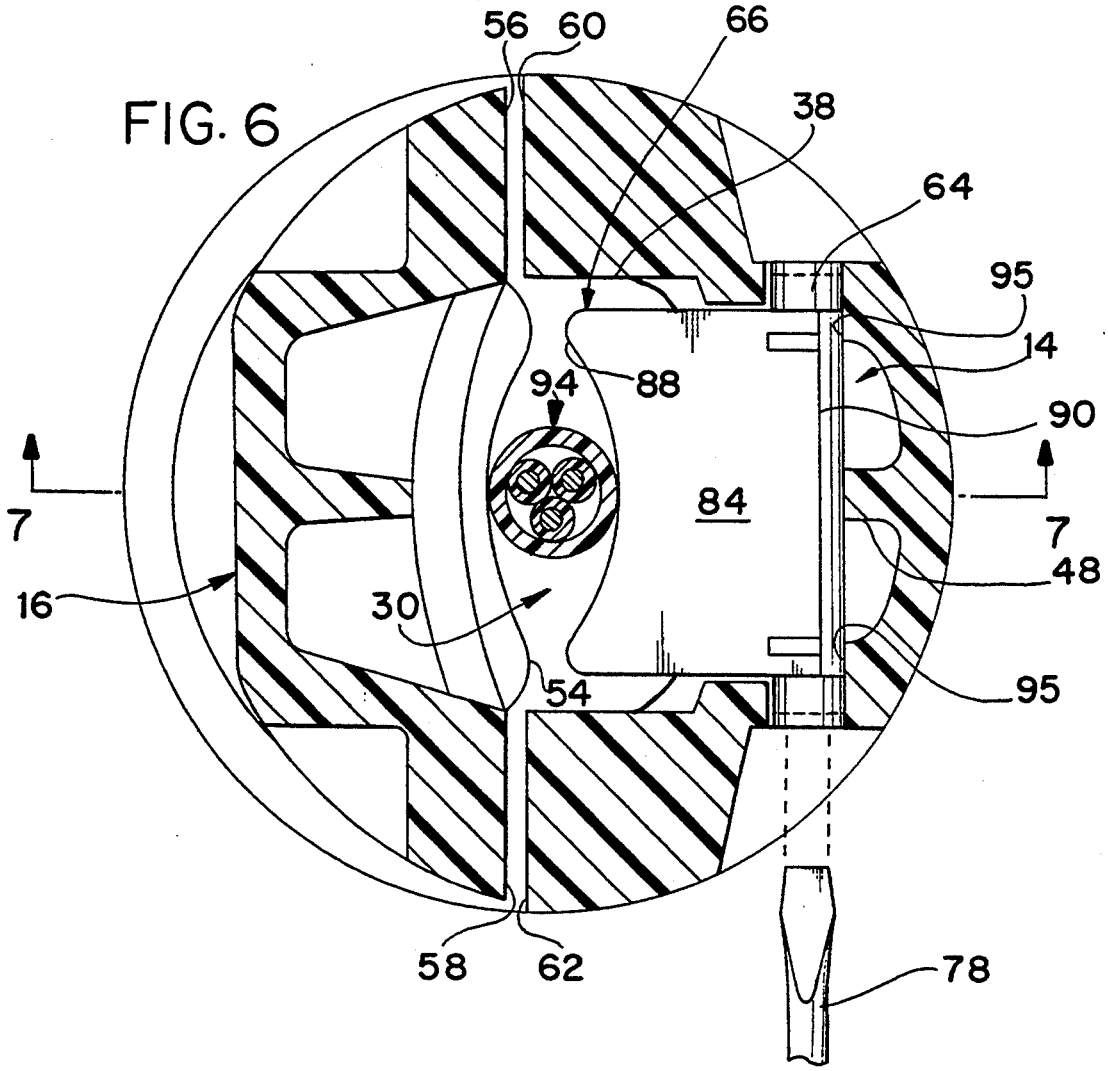
FIG. 6 is a cross-sectional top plan view of the embodiment of FIG. 5 as seen along line 6—6 of FIG. 5 and showing the electrical connector clamped by the pivotal clamping jaw where the pivotal clamping jaw is in a position to accommodate a small diameter electrical cable.

As shown in FIG. 4, the inner wall 38 of the fixed jaw 36 includes two U-shaped recesses 42 which open downwardly toward the lower end 32 of the main body 12. The upper end of the recess 42 includes a rounded portion 44 and a side opening or aperture 46 to define a window extending through the outer side wall 26 of the main body 12. As shown in FIG. 2, the opening 46 also defines a window to the axial passage 30 from the exterior of the main body 12. The inner wall 38 of the fixed jaw 36 further includes a axial rib 48 extending axially along the axial passage 30 of the main body and axial ribs 95 positioned adjacent each of the recesses 42 as shown in FIGS. 2 and 6. The lower end of the axial rib 48 includes a detent 50 as shown in FIG. 3 to cooperate with the pivoting clamping jaw 14, as discussed hereinafter in greater detail. As shown in FIG. 2, the inner wall 38 of the fixed jaw 36 includes the two U-shaped recesses 42 facing each other and being positioned on opposite sides of the inner wall 38. Each recess is essentially a mirror image of the other.

The movable clamping jaw 16, as seen in FIGS. 2–3, is separable from the main body 12. The movable jaw 16 includes two holes for receiving the screws 20 to bias the movable jaw toward the fixed jaw 36, and the pivoting clamping jaw 14. The screws 20 are received in self-threading bores in the fixed jaw 36. The two screws are spaced apart on opposite sides of the axial passage 30 so that the screws will not interfere with an electrical cable being positioned in the axial passage 30. The movable jaw 16 also includes a contoured inner surface 52 which cooperates with the gripping rib 40 and the pivoting clamping jaw 14. Raised gripping ribs 54 are disposed on the contoured surface 52 of the movable jaw 16 for engaging the electrical cable 18 being clamped in the axial passage 30. The raised gripping ribs 54 in the embodiment shown in FIG. 3 on the movable jaw 16 are perpendicular to the axial passage but may be arranged in a spiral manner with respect to the axial passage and oriented to criss-cross relative to the gripping rib 40 on the inner wall 38. As shown in FIG. 2, the screws interconnect the movable jaw 16 and the fixed Jaw 36 of the main body 12 to apply clamping forces therebetween. The movable jaw 16 includes flat faces 56 and 58 on opposite sides of the contoured inner wall 52 which oppose flat faces 60 and 62 of the fixed jaw 36 to limit the inward radial movement of the movable jaw 16.

Figure 8:
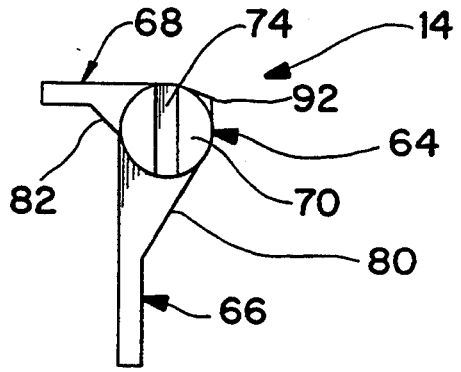
FIG. 8 is a side elevational view of the pivotal clamping jaw of the invention showing the two jaw elements for selectively clamping two different size electrical cables.
Figure 9:
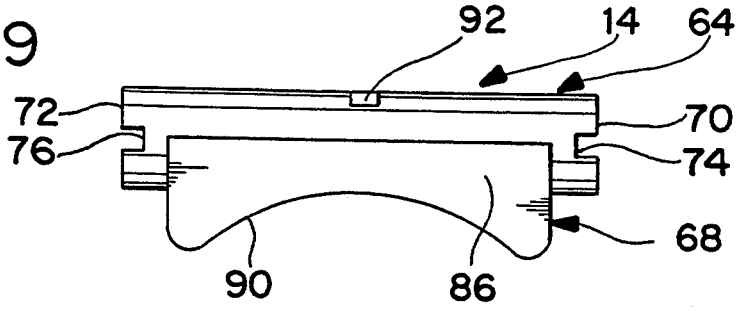
FIG. 9 is a top plan view of the pivotal clamping jaw as seen from the upper side of FIG. 8 and showing the jaw element for clamping a standard size electrical cable.
Figure 10:
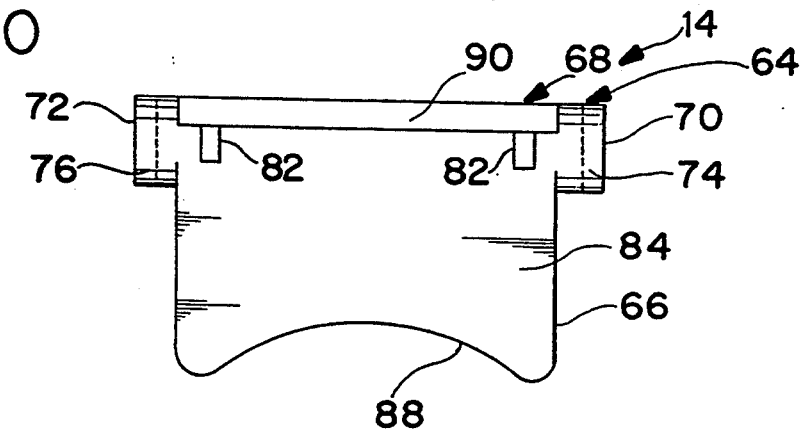
FIG. 10 is a side view of the pivotal clamping jaw as seen from the left side of FIG. 8 and showing the jaw element for clamping a small diameter electrical cable.

Referring to FIGS. 8–10, the pivoting clamping jaw 14 comprises a shaft 64 and clamping jaws 66 and 68. The shaft 64 has a substantially cylindrical shape to define a main body of the pivotal clamping jaw 14. The shaft 64 includes axial ends 70 and 72, each having a recess 74 and 76, respectively, for receiving a rotary tool 78 seen in FIGS. 2 and 6. In preferred embodiments, the recesses 74 and 76 are transverse slots for receiving a conventional screwdriver as shown in FIGS. 2 and 6. Alternatively, the recesses 74 and 76 may be shaped to receive a Phillips-type screwdriver, Allen wrench, star-type wrench or other suitable tool.

As shown in FIG. 8, the clamping jaw 66 is larger than the clamping jaw 68 with jaw 66 extending from the shaft a greater distance than jaw 68. In preferred embodiments of the invention as shown in FIG. 8, each of the clamping jaws 66 and 68 extends substantially tangentially from the shaft 64 and are angled about 90° from each other. Triangular shaped supports 80 and 82 extend from the shaft 64 to the clamping jaws 66 and 68, respectively, to provide added strength. Referring to FIGS. 9 and 10, the clamping jaws 66 and 68 each include a planar portion 84 and 86, respectively, terminating at contoured concave outer edges 88 and 90. In preferred embodiments, the contoured edges 88 and 90 each have a radius substantially the same as the gripping rib 40 on the inner wall 38 of the fixed jaw 36. In this embodiment, the clamping jaw 66 is larger than the clamping jaw 68 and the contoured edge 88 is spaced from the shaft 64 a greater distance than the contoured edge 90 of jaw 68. As shown in FIG. 8, the clamping jaws 66 and 68 are substantially perpendicular to each other. A centrally located detent 92 extends radially outward from the shaft 64 as shown in FIGS. 8 and 9. The clamping jaws 66 and 68 each have a width slightly less than the axial length of the shaft 64 so that the ends of the shaft can form a pivotal connection with the main body 12 of the electrical connector 10.

Figure 7:
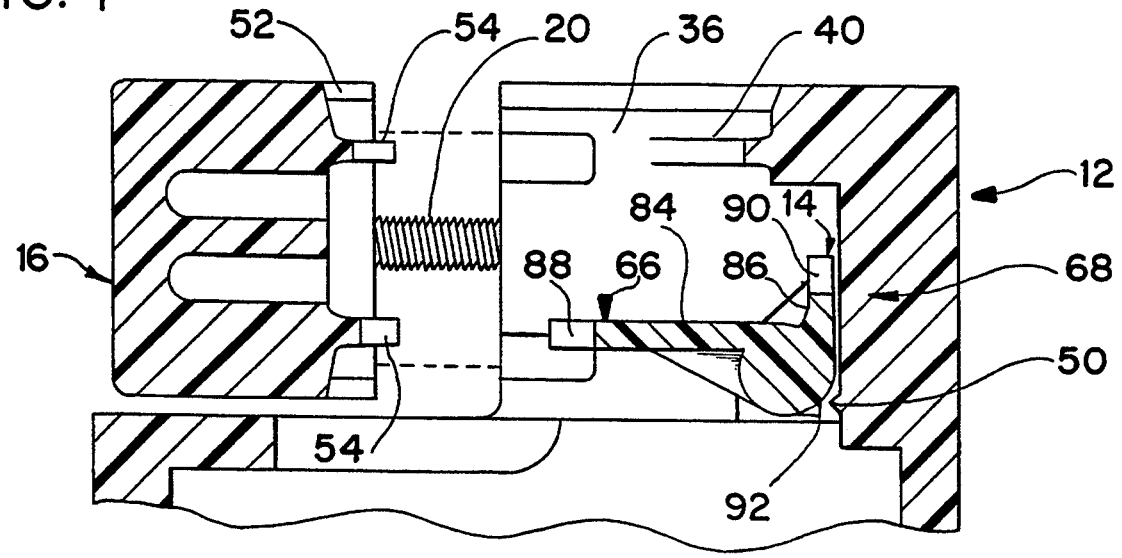
FIG. 7 is a partial cross-sectional view of the electrical connector of FIG. 6 as seen along line 7—7 of FIG. 6 with the electrical cable removed and showing the pivotal clamping jaw in a position to accommodate a small diameter electrical cable.

The electrical connector 10 is assembled by placing the pivotal clamping jaw 14 within the axial passage 30 and sliding the pivotal clamping jaw 14 into position with the axial ends of the shaft 64 received in the recesses 42. The pivotal clamping jaw 14 is pushed into the recesses 42 until the axial ends 70, 72 of the shaft 64 engage the rounded upper ends 44. In this position, the shaft 64 is perpendicular to the axial passage 30 and extends in a chordal direction relative thereto and relative to the substantially cylindrical main body 12. As shown in FIG. 3, the detent 50 extending from the axial rib 48 is positioned to interfere with the insertion of the pivoting clamping jaw 14 into the recesses 42. The detent 50 extends from the axial rib 48 a distance to contact the shaft 64 and define a snap connection of the jaw 14 into the recesses 42. The pivoting clamping jaw 14 is able to freely pivot from the position shown in FIG. 3 to the position shown in FIG. 7 while being retained in the main body by the detent 50. As shown in FIG. 3 and FIG. 7, the detent 92 on the shaft 64 of the pivoting clamping jaw 14 is arranged to engage the detent 50 as the pivoting clamping jaw 14 is rotated about the shaft 64. The pivoting clamping jaw 14 and the main body 12 are made from an insulating plastic material which has some resilience to provide the snap connection. The detents 50 and 92 are able to slide past each other to define a snap action to selectively retain the pivoting clamping jaw 14 in either the position shown in FIG. 3 or the position shown in FIG. 7.

Once the pivoting clamping jaw 14 is assembled into the main body 12, the electrical cable 18 can be connected to the electrical connector 10. As shown in FIGS. 1–3, the electrical cable 18 is a standard size electrical cable as commonly used in the industry. In this embodiment, the pivoting clamping jaw 14 is positioned so that the larger clamping jaw 66 extends axially in the axial passage 30 and the smaller clamping jaw 68 extends radially inward towards the axial passage 30. The electrical connector 10 is assembled by inserting the electrical cable 18 through the axial passage and making the necessary electrical connections to the blades 22. The movable clamping jaw 16 is then connected to the main body by inserting the screws 20 through the holes in the movable jaw 16 and the self-threading bores in the main body. The screws 20 are then tightened to apply clamping forces between the movable jaw 16 and the clamping jaw 68. The screws 20 are tightened sufficiently so that the raised gripping rib 40 and the pivoting clamping jaw 14 are compressed against the electrical cable to prevent axial movement of the electrical cable 18 within the axial passage.

In FIG. 1, a standard size electrical cable 18 is positioned in the electrical connector to substantially fill the axial passage 30. The pivoting clamping jaw 16 is positioned to engage the electrical cable 18 without damaging the cable. In preferred embodiments, the contoured edge 90 of the clamping jaw 68 is dimensioned to cooperate with the raised gripping rib 40 so that both the gripping rib 40 and the contoured edge 90 contact the electrical conductor when the clamping forces are applied. As shown in FIG. 2, the raised gripping ribs 54 and 40 and the clamping jaw 68 form an impression in the outer casing of the electrical cable when the clamping forces are applied. This effectively limits axial and transverse movement of the electrical cable 18 within the axial passage 30.

As shown in FIG. 3, the clamping jaw 68 extends from the shaft 64 at a tangent with respect to the shaft. When excessive clamping forces are applied from the movable jaw, the pivoting clamping jaw 14 may tend to pivot slightly in a clockwise direction as viewed in FIG. 3 so that the jaw 68 may tend to pivot upwardly. As the pivoting clamping jaw 14 pivots, the jaw 66 will engage the electrical conductor to prevent further rotation of the clamping jaw 14.

Figure 5:
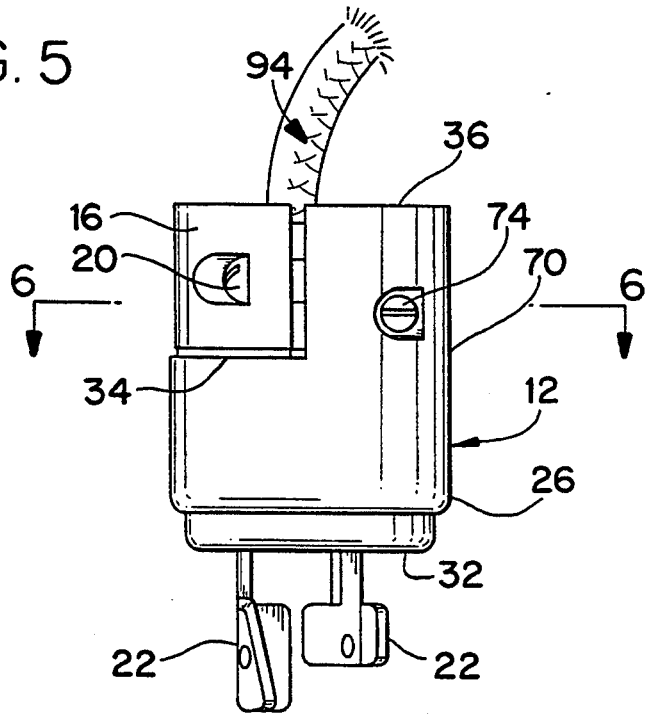
FIG. 5 is a side elevational view of the invention showing an electrical connector receiving an electrical cable having an outer diameter less than a standard electrical cables.

The electrical conductor 10 is adapted for receiving and gripping an electrical cable having a smaller outer diameter than a standard size electrical cable. In preferred embodiments, the connector 10 is manufactured and shipped with the pivoting clamping jaw 14 in the position shown in FIG. 3 so that the connector can be used on a standard size cable without any adjustment being required. To accommodate a smaller size electrical cable 94, as shown in FIGS. 5–7, the rotary tool 78 is inserted through the opening 46 to engage one of the recesses 74 and 7-6 in the axial end of the pivoting clamping jaw 14. The pivoting clamping jaw 14 is rotated 90° to the position shown in FIGS. 6 and 7 so that the small clamping jaw 68 extends axially upward toward the top end of the step portion 36 and the large clamping jaw 66 extends radially inward toward the axial passage 30. The electrical cable 94 is inserted into the axial passage and connected to the blades 22 in a conventional manner. The screws 20 are then tightened to bias the movable jaw 16 toward the pivoting clamping jaw 14 and to apply clamping forces therebetween. As shown in FIG. 6, the electrical cable 94 is clamped between the gripping ribs 54 of the movable jaw 16 and the contoured edge 88 of the jaw 66.

As shown in FIG. 7, the jaw 66 extends from the shaft 64 at a tangent and is positioned approximately 90° from the jaw 68. The jaw 68 extends axially upward and is shown engaging the axial rib 48 on the inner wall 36 of the main body. The gripping forces applied between the movable jaw and the pivoting jaw 14 tend to cause the jaw 66 to rotate upwardly toward the top end of the main body. Rotation of the jaw 66 beyond the horizontal position shown in FIG. 7 is resisted by the jaw 68 engaging the axial rib 48 and axial ribs 95 as shown in FIG. 6.

In the embodiment of FIGS. 1–10, the electrical connector 10 is able to effectively clamp at least two different size electrical cables by selectively adjusting the position of the pivotal clamping jaw 14. The pivotal clamping jaw 14 is accessible through the openings 46 in the main body using a suitable tool so that the pivoting jaw 14 can be rotated to either the position shown in FIG. 3 or FIG. 7. The pivoting clamping jaw 14 is retained in the main body and it is not necessary to disassemble the device to change from one clamping mode to another.

In preferred embodiments, the pivotal clamping jaw includes two planar jaws of different sizes. In alternative embodiments, the smaller jaw may be eliminated so that when a standard size electrical cable is being clamped, the clamping forces are applied between the movable jaw and the shaft of the pivotal jaw. To clamp a small size electrical cable, the large planar jaw is pivoted to project radially inward toward the axial passage.

While advantageous embodiments have been chosen to illustrate the invention, it will be understood by those skilled in the art that various changes and modifications can be made therein without departing from the scope of the invention as defined in the following claims.

What is claimed is:

1. An electrical cable clamp comprising:

a main body having an axial passage for receiving the electrical cable; and first clamping means, for applying clamping forces to the electrical cable, said first clamping means cooperating with said axial passage and being coupled to said main body;

said first clamping means being pivotally mounted in said main body and being pivotal about an axis perpendicular and chordal to said axial passage from a first position to accommodate a first electrical cable to a second position to accommodate a second electrical cable having a cross-sectional dimension less than said first electrical cable;

said first clamping means including a first electrical cable engaging jaw element extending transversely from said axis, and a second electrical cable engaging jaw element extending transversely from said axis at an angular position angularly spaced from said first jaw element;

said first and second cable engaging jaw elements extending tangentially from said axis.

2. The clamp of claim 1, and further comprising a second movable clamping means, and interconnecting means coupling said second clamping means to said main body and for applying clamping forces therebetween.

3. The clamp of claim 1, wherein said main body has a plurality of electrical contacts.

4. The clamp of claim 1, wherein said first clamping means comprises a substantially cylindrical body having axial ends pivotally coupled to said main body.

5. The clamp of claim 4, wherein said cylindrical body has axial ends, at least one of said ends having means for rotating said cylindrical body with respect to said main body.

6. The clamp of claim 4, wherein said main body has a pair of spaced-apart openings in a side wall of said main body, one of said axial ends of said cylindrical body being rotatably mounted in each of said openings.

7. An electrical cable clamp comprising:

a main body having an axial passage for receiving the electrical cable; and first clamping means, for applying clamping forces to the electrical cable, said first clamping means cooperating with said axial passage and being coupled to said main body and having a substantially cylindrical body having axial ends pivotally coupled to said main body, a first electrical cable engaging jaw element extending transversely from said cylindrical body, and a second electrical cable engaging jaw element extending transversely from said cylindrical body at an angular position angularly spaced from said first jaw element, said first clamping means being pivotally mounted in said main body and being pivotal about an axis perpendicular and chordal to said axial passage from a first position to accommodate a first electrical cable to a second position to accommodate a second electrical cable having a cross-sectional dimension less than said first electrical cable, said first and second electrical cable engaging jaw elements being substantially planar.

8. The clamp of claim 7, wherein said first electrical cable engaging jaw element has an outwardly facing concave edge for engaging said first electrical cable, said concave edge being substantially parallel to said cylindrical body and perpendicular to said axial passage.

9. The clamp of claim 8, wherein said first electrical cable engaging jaw element has an outwardly facing concave edge for engaging said second electrical cable, said concave edge being spaced from said cylindrical body a distance greater than the concave edge of said first cable engaging jaw element.

10. The clamp of claim 9, wherein said first and second cable engaging jaw elements extend tangentially from said cylindrical body.

11. The clamp of claim 9, wherein said first and second cable engaging jaw elements are substantially perpendicular to each other.

12. The clamp of claim 10, wherein said rotating means comprises a recess in said axial end for receiving a rotary tool.

13. The clamp of claim 10, wherein said main body has at least one aperture in a side wall thereof for receiving said axial end of said cylindrical body having said rotating means thereon, said rotating means being accessible through said aperture by a rotary tool.

14. An electrical cable clamp comprising:

a main body having an axial passage for receiving the electrical cable;

first clamping means, for applying clamping forces to the electrical cable, said first clamping means cooperating with said axial passage and being coupled to said main body;

said first clamping means being pivotally mounted in said main body and being pivotal about an axis perpendicular and chordal to said axial passage from a first position to accommodate a first electrical cable to a second position to accommodate a second electrical cable having a cross-sectional dimension less than said first electrical conductor, said first clamping means comprising a substantially cylindrical body having axial ends pivotally coupled to said main body, said main body having means for rotably coupling said cylindrical body in said main body, said means comprising a pair of substantially U-shaped recesses disposed of an inner wall of said main body.

15. The clamp of claim 14, wherein said main body further comprises a pair of openings extending through an outer wall of said main body in communication with said U-shaped recesses.

16. The clamp of claim 14, wherein said main body further comprises first detent means extending from said main body and being spaced between said U-shaped recess for retaining said cylindrical body seated in said U-shaped recesses.

17. The clamp of claim 16, and further comprising second detent means extending radially from and operatively disposed on said cylindrical body for engaging said first detent means to define a snap pivotal movement from said first position to said second position.

18. An electrical cable clamping assembly including a main body having an inner wall defining an axial passage for receiving an electrical cable, and a clamping assembly for clamping said electrical cable in said axial passage, said clamping assembly comprising:

first and second opposing clamping means; and means for interconnecting said first and second clamping means and for converging said first clamping means toward said second clamping means and applying clamping forces to an electrical cable located between said first and second clamping means;

said first clamping means being pivotal about an axis perpendicular and chordal to said axial passage from a first position to a second position;

said first clamping means including means for selectively clamping at least two different sizes of electrical cables in said axial passage including a first electrical cable engaging jaw element extending transversely from said axis, and a second electrical cable engaging jaw element extending transversely from said axis at an angular position angularly spaced form said first jaw element;

said second clamping means being radially movable with respect to said axial passage in said main body.

19. The clamping assembly of claim 18, wherein said second clamping means comprises a movable jaw, and said interconnecting means couples said movable jaw to said main body for biasing said movable jaw toward said axial passage.

20. The clamping assembly of claim 19, wherein said movable jaw has an arcuate inner surface facing said axial passage.

21. The clamping assembly of claim 20, wherein said inner surface of said movable jaw includes raised ribs for engaging an electrical conductor in said axial passage.

22. The clamping assembly of claim 18, wherein said first clamping means comprises a body having axial ends pivotally coupled to said main body.

23. An electrical cable clamping assembly including a main body having an inner wall defining an axial passage for receiving an electrical cable, and a clamping assembly for clamping said electrical cable in said axial passage, said clamping assembly comprising:

first and second opposing clamping means; and means for interconnecting said first and second clamping means and for converging said first clamping means toward said second clamping means and applying clamping forces to an electrical cable located between said first and second clamping means;

said first clamping means being pivotal about an axis perpendicular and chordal to said axial passage from a first position to a second position;

said first clamping means including a body having axial ends pivotally coupled to said main body, and means for selectively clamping at least two different sizes of electrical cables in said axial passage including a first electrical cable engaging jaw element extending transversely from said body, and a second electrical cable engaging jaw element extending transversely from said body at an angular position angularly spaced from said first jaw element;

said second clamping means being radially movable with respect to said axial passage in said main body.

24. The clamping assembly of claim 23, wherein said first electrical cable engaging jaw element is substantially planar and has an outwardly facing concave edge for engaging a first electrical cable, said concave edge being substantially parallel to said body and perpendicular to said axial passage.

25. The clamping assembly of claim 24, wherein said second electrical cable engaging jaw element is substantially planar and has an outwardly facing concave edge for engaging a second electrical cable, said concave edge being spaced from said body a distance greater than the concave edge of said first cable engaging jaw element.

26. The clamp of claim 25, wherein said body is substantially cylindrical and said first and second cable engaging Jaw elements extend tangentially from said cylindrical body.

27. The clamp of claim 25, wherein said first and second cable engaging jaw elements are substantially perpendicular to each other.

28. The clamp of claim 26, wherein said cylindrical body has axial ends, at least one of said ends having means for rotating said cylindrical body with respect to said main body.

29. The clamp of claim 28, wherein said rotating means comprises a recess in said axial end for receiving a rotary tool.

30. The clamping assembly of claim 28, wherein said main body has at least one opening in a side wall thereof proximate said rotating means for receiving a rotary tool.

31. The clamping assembly of claim 26, wherein said main body has means for rotatably coupling said cylindrical body in said main body, said means comprising a pair of substantially U-shaped recesses disposed on an inner wall of said main body.

32. The clamping assembly of claim 31, wherein said main body further comprises first detent means extending from said main body and being spaced between said U-shaped recesses for retaining said first clamping means in said main body.

33. The clamping assembly of claim 32, and further comprising second detent means extending radially from and operatively disposed on said first clamping means for engaging said first detent means to define a snap pivotal movement from a first position to a second position.

34. An electrical device for clamping at least two different diameter electrical cables, said device comprising:

a main body having an axial passage for receiving an electrical cable;

first clamping means coupled to said main body about a pivotal axis perpendicular and chordal to said axial passage, said first clamping means including first and second jaws extending transversely therefrom and spaced angularly apart with respect to said pivotal axis, said first clamping means being pivotal from a first clamping position where said first jaw clamps a first electrical cable to a second clamping position where said second jaw clamps a second electrical cable having a larger diameter than the first electrical cable;

second clamping means being movable with respect to said axial passage and facing said first clamping means; and means for interconnecting said first clamping means and said second clamping means and applying a clamping force between said first and second clamping means.

35. The electrical device of claim 34, wherein said second clamping means comprises a movable jaw and being movable radially inward toward said axial passage with respect to said main body.

36. The electrical device of claim 34, wherein said first clamping means further comprises a body having axial ends pivotally coupled to said main body.

37. The electrical device of claim 36, wherein said main body includes a pair of spaced-apart substantially U-shaped recesses; and said axial ends being received in said recesses to pivotally couple said first clamping means to said main body.

38. The electrical device of claim 37, wherein said main body further comprises first detent means extending from said main body and being spaced between said recesses for retaining said first clamping means in said recesses.

39. The electrical device of claim 38, and further comprising second detent means extending radially from and operatively disposed on said first clamping means for engaging said first detent means to define a snap pivotal movement from said first position to said second position.

40. An electrical device for clamping at least two different diameter electrical cables, said device comprising:

a main body having an axial passage for receiving an electrical cable;

first clamping means coupled to said main body about a pivotal axis perpendicular and chordal to said axial passage, said first clamping means including a body having axial ends pivotally coupled to said main body, and first and second jaws extending transversely therefrom with respect to said pivotal axis, said first clamping means being pivotal from a first clamping position where said first jaw clamps a first electrical cable to a second clamping position where said second jaw clamps a second electrical cable having a larger diameter than the first electrical cable;

second clamping means being movable with respect to said axial passage and facing said first clamping means;

means for interconnecting said first clamping means and said second clamping means and applying a clamping force between said first and second clamping means;

said first jaw having an outwardly facing first concave edge for engaging a first electrical cable, said first concave edge being substantially parallel to said body and perpendicular to said axial passage; and said second jaw having a second outwardly facing concave edge for engaging a second electrical cable, said second concave edge being spaced from said cylindrical body a distance greater than the concave edge of said first jaw.

* * * * *